United States Patent [19]

Belmont et al.

[11] Patent Number: 4,813,792

[45] Date of Patent: Mar. 21, 1989

[54] HAND-GRIP FOR THERMOPLASTIC DRAW TAPE HANDLES FOR THERMOPLASTIC BAGS

[75] Inventors: Kirk E. Belmont, Fairport; Edward M. Bullard, East Rochester; Daniel J. DiBiasi, Pittsford; Edward W. Forman, Jr.; David E. McIntyre, both of Palmyra, all of N.Y.

[73] Assignee: Mobil Oil Corporation, New York, N.Y.

[21] Appl. No.: 201,799

[22] Filed: Jun. 3, 1988

[51] Int. Cl.[4] ..... B65D 33/28

[52] U.S. Cl. ..... 383/75; 383/6; 383/13; 383/17

[58] Field of Search ..... 383/72, 17, 75, 6, 7, 383/12, 13

[56] References Cited

U.S. PATENT DOCUMENTS

| | | | |
|---|---|---|---|
| 3,029,853 | 4/1962 | Piazzi . | |
| 3,592,379 | 7/1971 | Nakamura | 383/75 |
| 3,738,568 | 6/1973 | Ruda . | |
| 3,774,838 | 11/1973 | Christie | 383/77 |
| 4,165,832 | 8/1979 | Kuklies et al. . | |
| 4,558,463 | 12/1985 | Boyd . | |
| 4,597,750 | 6/1986 | Boyd . | |
| 4,617,008 | 10/1986 | Boyd et al. . | |
| 4,624,654 | 11/1986 | Boyd et al. . | |
| 4,628,536 | 12/1986 | Herrington . | |

FOREIGN PATENT DOCUMENTS

| | | | |
|---|---|---|---|
| 759314 | 5/1967 | Canada | 383/75 |
| 2215612 | 11/1973 | Fed. Rep. of Germany | 383/75 |
| 1125363 | 8/1968 | United Kingdom . | |
| 1176612 | 1/1970 | United Kingdom | 383/75 |

*Primary Examiner*—Willis Little

*Attorney, Agent, or Firm*—Alexander J. McKillop; Charles J. Speciale

[57] ABSTRACT

A hand-grip for thermoplastic draw tape handles for thermoplastic bags and method of making the same is disclosed. The hand-grip is produced by perforating each hem of the thermoplastic bag at a center section thereof with a substantially U-shaped perforation extending from the mouth of the bag to a location below the bottom of the hem whereby the center section of each hem is separable from the bag along the U-shaped perforation to provide a hand-grip surrounding each draw tape when the bag is lifted by the draw tapes.

5 Claims, 1 Drawing Sheet

HAND-GRIP FOR THERMOPLASTIC DRAW TAPE HANDLES FOR THERMOPLASTIC BAGS

FIELD OF THE INVENTION

The present invention relates to thermoplastic draw tape handles inserted in thermoplastic bags, and in particular, to a hand-grip for draw tape handles especially designed to minimize the discomfort caused by "roping" at the hand area while the bag is under load. The term "roping" refers to the tendency to form a round cross-section with a small diameter across the palm of the hand of the carrier in low gauge/high strength thermoplastic draw tapes while the bag is under load.

BACKGROUND OF THE INVENTION

Bags made of thin polyethylene material have been used in various sizes. Small bags are used in packaging of sandwiches and the like. Larger bags are used as shopping bags. Even larger bags are used for containing trash.

A particularly advantageous closure for such a bag includes a draw tape made from the same polyethylene material as the bag. U.S. Pat. No. 3,029,853 - Piazzi, British Pat. No. 1,125,363 Jortikka, U.S. Pat. No. 3,738,568 - Ruda, U.S. Pat. No. 4,558,463 - Boyd and U.S. Pat. No. 4,624,654 Boyd et al are examples of draw tape bags. Such closures have been successfully employed in these bags. Draw tape closures for large bags, and the manufacture of these draw tape bags are described in the aforesaid related U.S. Pat. Nos. 4,558,463 and 4,624,654. Other related patents are U.S. Pat. No. 4,617,008 - Boyd et al which describes a hem forming apparatus and U.S. Pat. No. 4,597,750 - Boyd et al which describes apparatus for inserting a draw tape into the bag. Bags having intermittently oriented draw tapes are disclosed in related U.S. Pat. No. 4,628,536 - Herrington. The disclosure of the foregoing related patents are incorporated herein by reference.

In the past, thermoplastic bag structures with integral handle elements formed as an integral part of the bag structure itself have been produced by a method which reduces stress concentration. Stress points around the bag mouth are distribute to areas which are less likely to rupture as a result of stress concentration. See U.S. Pat. No. 4,165,832 - Kuklies et al. This patent discloses a thermoplastic bag structure with integral handle elements, i.e. the handles are actually an extension of the bag proper and stress relief notches are positioned at opposite ends of the mouth. This patent also discusses the effect of "roping" while the bag is under load. Another technique that has been employed in th past in connection with integral handles of thermoplastic bags is to place patches of additional thermoplastic material around the handle openings. These patches are heat sealed or spot welded to the handle portions.

Draw tape bags have a draw tape that is a separate structure from the bag proper. Draw tape bags of the type made according to the above mentioned Boyd et al patents normally have a 1" wide draw tape for the full width of the bag. When the tape is pulled hard to close the bag, it elongates over most of its length and the area where it is gripped by the hand, becomes narrow, or "ropes" and hurts the hand. It is possible to make a draw tape that is sufficiently strong at thin gauges, such as 1.5 mils, but this tape is unsatisfactory for use because of the "roping" effect. As a result, it has been customary to use a tape material that is thicker, thus more costly than that which is required for performance. For example, tape thicknesses that have been used are in the order of 3 to 4 mils, about twice what is actually required.

It is desirable to produce a thermoplastic bag handle of a smaller gauge, less costly material, while substantially preventing "roping" at the area of the handle held by the hand of the carrier.

The following related patent applications disclose draw tape configurations for draw tape bags especially designed to reduce stress concentrations or "roping" at the hand area while the draw tape bag is under load.

RELATED APPLICATIONS:

"Ribbed Draw Tape for Thermoplastic Bag", Edward M. Bullard, Ser. No. 71,196, filed July 9, 1987 describes a draw tape for a bag having transverse or angular ribs which reduce roping of the draw tape when lifting a loaded bag. "Variable-Width Draw Tape for Thermoplastic Bags", Daniel J. DiBiasi and Fox J. Herrington, Ser. No. 134,270 filed Dec. 14, 1987 describes a draw tape for a bag where the draw tape is made wider at the center area where it is gripped by hand for forcing any elongation to occur at some other point thereby preventing "roping" at the hand area. "Non-Roping Thermoplastic Draw Tape for Thermoplastic Bags", Daniel J. DiBiasi and David A. Bryniarski, Ser. No. 157,753 filed Feb. 19, 1988 describes a reinforced draw tape handle with a reinforcing patch. "Method and Apparatus for Making Non-Roping Thermoplastic Draw Tape for Thermoplastic Bags", David A. Bryniarski and E. Grosz, Ser. No. 157,751 filed Feb. 19, 1988 describes a method and apparatus to permit continuous application of a reinforcing patch to a draw tape at the center area where it is gripped by hand. "Multiple Layer Hand-Grip Reinforcement for Thermoplastic Draw Tape Handles for Thermoplastic Bags", Kirk Belmont et al Ser. No. 201,798 filed June 3, 1988 describes a multiple layer hand-grip reinforcement handle for draw tape bags and the method of making the same. "Reinforced Handle for Thermoplastic Draw Tape Bags", Kirk Belmont et al, Ser. No. 201,723 filed June 3, 1988 describes a padded hand-grip for a draw tape bag and method of making the same. The disclosures of the foregoing applications are assigned to the same assignee as the present application and are incorporated herein by reference.

It is desirable to produce a thermoplastic bag handle of a smaller gauge, less costly material, while minimizing the discomfort caused by "roping" by providing a hand-grip at the central area of the handle held by the hand of the carrier.

SUMMARY OF THE INVENTION

A thermoplastic draw tape bag wherein the discomfort caused by "roping". at the area of the handle of low gauge/high strength thermoplastic draw tapes held by the hand of the carrier is reduced by applying a hand grip to the handle. The hand grip is formed from adjacent layers of the thermoplastic bag material. The adjacent layers are perforated portions of the hems which enclose the draw tapes and are pulled away from the bag when it is desired to lift the bag by the draw tapes.

In accordance with another aspect of the invention there is provided a method of providing a hand-grip particularly suited for a low gauge/high strength thermoplastic draw tape for thermoplastic draw tape bags of the type having a mouth at one end defined by a lip portion having a pair of hems providing a tunnel for the draw tapes, the ends of the draw tapes being secured to the side edges of the bag at the ends o the hems. The method comprises perforating each hem at a center section thereof with a substantially U-shaped perforation extending from the mouth of the bag to a location below the center of the hem whereby the center section of each hem is separable from the bag along the U-shaped perforation to provide a hand-grip surrounding each draw tape when the bag is lifted by the draw tapes.

The foregoing and other objects, features and advantages of the invention will be more apparent from the following detailed description and appended claims.

SHORT DESCRIPTION OF THE DRAWINGS

DESCRIPTION OF THE PREFERRED EMBODIMENT

Figure 1:
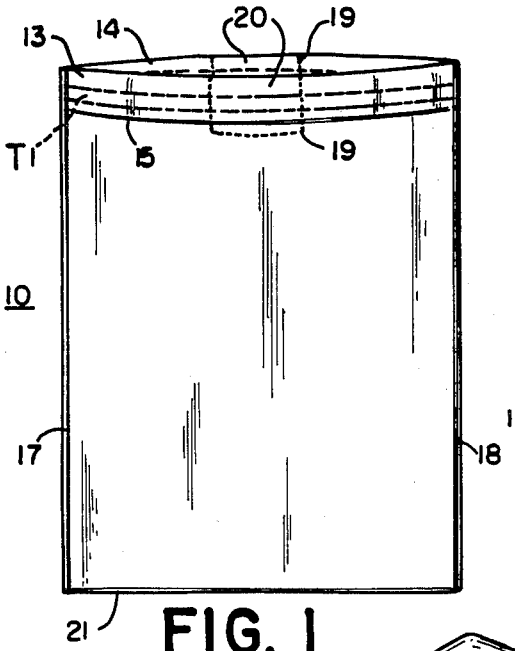
FIG. 1 shows a thermoplastic draw tape bag including a thermoplastic draw tape with a hand-grip embodying the present invention.
Figure 2:
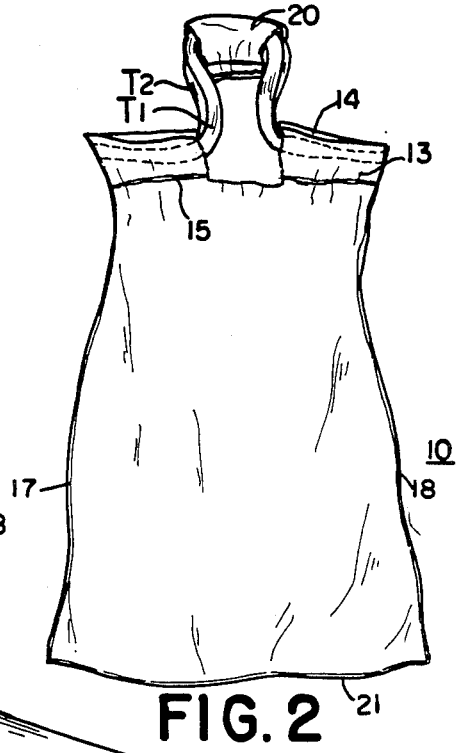
FIG. 2 shows the thermoplastic draw tape bag of FIG. 1 after the hand-grips have been separated from the bag body.

Referring to FIG. 1 there is shown a draw tape bag 10. The bag 10 includes two panels 11 and 12, FIGS. 3 and 4, formed from an extruded tube of polyethylene which is slit along the side to form an open top. The hems 13 and 14 of each panel are folded over adjacent the top and heat sealed horizontally at 15 and 16, FIG. 4. The sides of the panels 11 and 12 are heat sealed at 17 and 18 and cut from the tube in a perpendicular direction. Draw tapes $T_1$ and $T_2$ of thin gauge polyethylene, such as 1.5 mils are inserted into the respective hems 13, 14 and secured by the heat seals 17 and 18 at the sides of the panels. A substantially U-shaped perforation 19 in the center of the hem of each panel at the middle of the bag defines the hand-grip 20 at the center sections of the draw tapes $T_1$ and $T_2$ so that they can be grasped. The hand-grip 20 for each of the draw tapes $T_1$ and $T_2$ is hereinafter described. When the bag 10 is loaded as shown in FIG. 2, the draw tapes $T_1$ and $T_2$ are grasped at the center section through the hand-grips 20, 20 and lifted, thereby separating the hand-grips 20, 20 from the mouth of the bag.

Figure 3:
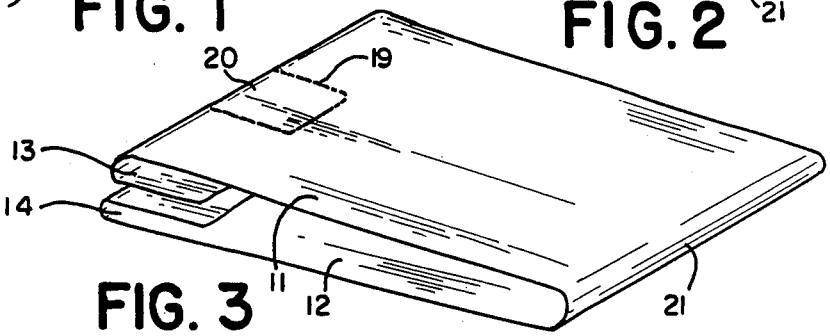
FIG. 3 shows the formation of a thermoplastic draw tape bag body of the type shown in FIGS. 1 and 2.
Figure 4:
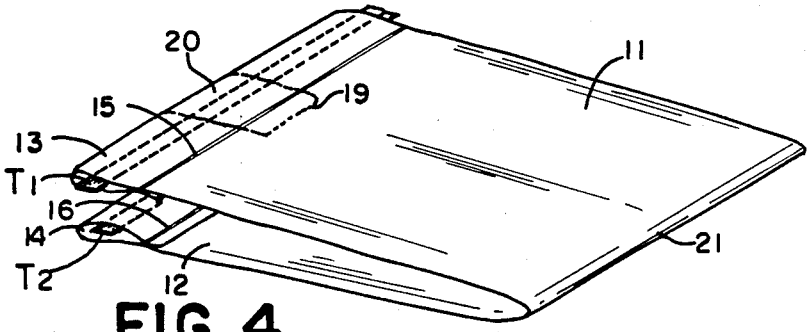
FIG. 4 shows the bag body of FIG. 3 after the insertion of the draw tapes.

While the completed bag has been illustrated in FIGS. 1 and 2, reference will now be made to FIGS. 3 and 4 to describe the method of making the bags. As may be seen in FIG. 3 the extruded tube of polyethylene has been slit along the side to provide two free edges which are adapted to be folded inwardly to form a pair of hems 13 and 14 for the respective panels 11 and 12 of the bag. The bottom of the bag is formed by the folded edge 21. After the hems 13 and 14 have been folded over as shown in FIG. 3 the central areas thereof are provided with U-shaped perforations 19 which extend through both layers of each of the hems 13 and 14. The perforations 19 define the periphery of the center sections of each of the hems which provide the hand-grips 20 for the draw tapes. After the thermoplastic web for the bags have been provided with hems 13 and 14 and perforations 19, the tapes $T_1$ and $T_2$ are inserted in the respective hems 13 and 14 as shown in FIG. 4. The respective hems 13 and 14 are then sealed at the bottom at 15 and 16 thus providing a tunnel for the draw tapes at the lip portion of the bag. It will be noted in FIG. 4 that the U-shaped perforation 19 extends from the top of the bag downwardly across the hem 13 and the bottom seal 15 thereof, along the bottom seal 15 and then upwardly through the bottom seal and the hem 13 to the top of the bag. It is important that the U-shaped perforation 19 extend below the seal lines 15 and 16 so that when the hand-grip section 20 is separated from the bag the respective draw tapes $T_1$ and $T_2$ will be confined within the hand-grips. This is clearly shown in FIG. 2.

After the draw tapes $T_1$ and $T_2$ have been inserted in the respective hems 13, 14 as illustrated in FIG. 4, the side seals 17 and 18 for the bag are made. During this operation both the front and back panels 11 and 12 are sealed along their sides to each other at 17 and 18 and the ends of the draw tapes $T_1$ and $T_2$ are also sealed to the side edges of the bag along the seal lines 17 and 18. Thus when the hand-grip portions 20 are pulled and separated from the bag body as shown in FIG. 2 the ends of the respective draw tapes $T_1$ and $T_2$ remain sealed along the side seals 17 and 18 thus causing the open mouth of the bag 10 to move toward a closed condition.

While the perforation 19 has been described and illustrated as substantially U-shaped it is to be understood that other suitable closed area configurations for the perforation may be used within the scope of the present invention so long as they will provide for separation of a suitable hand-grip 20 from the hem portions of the bag. The hand-grips 20 on the bag handles comprise one layer of the bag film wrapped and sealed around the draw tape. The hand-grips can be left free or fastened to the draw tape by sealing, gluing, or other means if desired. Since the hand grips 20 are formed by the bag material which normally is of thicker gauge than the draw tapes and since it is wider than the draw tapes it minimizes the discomfort experienced from the tape tending to cut the hand when lifting a filled bag. The hand-grips also permit the use of very thin tapes that exceed handle strength requirements but because of their thinness tend to "rope" into a cord and cut ones hand when lifting a filled bag.

What is claimed is:

1. A thermoplastic draw tape bag for carrying trash and the like having a hand-grip for the draw tape comprising:

two thermoplastic panels forming an open top, closed bottom bag, said panels being joined along the sides of said bag;

a hem on each of said panels being folded over adjacent said top, the bottom of each said hem being sealed to the adjacent panel, each said hem having at a center section thereof a substantially closed area perforation extending from the top of the bag downwardly across the hem and the bottom seal thereof, along the bottom seal and then upwardly through the bottom seal and the hem to the top of the bag, said perforation extending through both layers of the hem; and a thermoplastic draw tape in each said hem secured to the side of said panels, said center section of each of said hems being separable from the bag along said perforation to provide a hand-grip for each tape when the bag is lifted by the draw tapes.

2. A thermoplastic draw tape bag according to claim 1 wherein said perforation is substantially U-shaped.

3. A method of providing a hand-grip particularly suited for low gauge/high strength thermoplastic draw tapes for thermoplastic draw tape bags of the type having a mouth at one end defined by a lip portion having a pair of hems providing a tunnel for the draw tapes, the ends of the draw tapes being secured to the side edges of the bag at the ends of the hems, said method comprising perforating each hem at a center section thereof with a substantially U-shaped perforation extending from the mouth of the bag to a location below the bottom of the hem whereby the center section of each hem is separable from the bag along the U-shaped perforation to provide a hand-grip surrounding each draw tape when the bag is lifted by the draw tapes.

4. A method of making a thermoplastic bag having thermoplastic draw tapes with integral hand-grips comprising the steps of slitting a tube of polyethylene along the side thereof to form a web having free edges at one side and a folded edge at the other, folding the free edges of the web toward each other between the layers of the web to provide a pair of hems, perforating the web material through both of the hems intermediate the ends thereof to outline a closed area of the hems for a hand-grip, inserting a draw tape into each of the hems, sealing the bottoms of each of the hems to form a tunnel for the draw tapes, and sealing the side edges of the bags and the ends of the draw tapes to provide an open mouth draw tape bag having a hand-grip for the draw tapes separable from the hems of the bag along the perforated outline.

5. A method of making a thermoplastic bag according to claim 4 wherein the perforated outline is substantially U-shaped.

* * * * *